US005235793A

United States Patent [19]

Heudecker

[11] Patent Number: 5,235,793

[45] Date of Patent: Aug. 17, 1993

[54] APPARATUS FOR CLOSING VESSELS

[75] Inventor: Gerhard Heudecker, Pentling, Fed. Rep. of Germany

[73] Assignee: KRONES AG Hermann Kronseder Maschinenfabrik, Neutraubling, Fed. Rep. of Germany

[21] Appl. No.: 858,732

[22] Filed: Mar. 27, 1992

[30] Foreign Application Priority Data

Mar. 28, 1991 [DE] Fed. Rep. of Germany ... 9103889[U]
Feb. 14, 1992 [DE] Fed. Rep. of Germany ... 9201857[U]

[51] Int. Cl.[5] ..... B67B 3/02; B65B 65/00; B65B 7/28

[52] U.S. Cl. ..... 53/167; 53/308

[58] Field of Search ..... 53/331.5, 317, 310, 53/312, 359, 343, 488, 314, 167, 306, 308; 141/90, 91

[56] References Cited

U.S. PATENT DOCUMENTS 3,912,535 10/1975 Rausér ..... 53/167 X
4,389,833 6/1983 Knabe ..... 53/310 X
4,527,377 7/1985 Hayashi et al. ..... 53/167
5,040,354 8/1991 Ahlers et al. ..... 53/167

FOREIGN PATENT DOCUMENTS 88159566 8/1990 Fed. Rep. of Germany .
3918504 12/1990 Fed. Rep. of Germany .

*Primary Examiner*—Horace M. Culver
*Attorney, Agent, or Firm*—Finnegan, Henderson, Farabow, Garrett & Dunner

[57] ABSTRACT

Invention relates to a closing apparatus for capping vessels having means for permitting a faster and easier connection and disconnection of a wash flushing device. A flushing element cap is provided which is inserted into the opening which is located at the bottom surface of the pressing means where closing caps are secured to the mouth of a vessel. A channel is formed which permits the flushing of the surfaces of the closing tool exposed to the fluids contained in the vessels. Utilizing the flushing cap element results in a compact structure that requires little space, so that cumbersome and time-consuming equipment changes are avoided during a cleaning operation of the closing apparatus.

12 Claims, 3 Drawing Sheets

APPARATUS FOR CLOSING VESSELS

This invention relates to an apparatus for closing vessels.

Apparatuses of the above-mentioned type are mainly used in vessel filling systems for mounting a cap on a filled, but still open vessel. It may, however, happen that the closing tool comes into contact with the filling substance exiting from the vessel, for instance with beer froth, i.e., either immediately before or during the closing operation. These remainders of the filling substance may deposit in cracks and crevices of the closing tool, forming a nutritive medium for undesired microorganisms that will propagate and possibly infect the filling substance in the vessels to be closed. The demand that closing apparatuses should be designed such that they can be cleaned and sterilized without any problems from time to time is therefore made more and more often. To this end, it is necessary that the closing tool which is in its open state should be closed with a flushing container or a flushing cap, so that it can be flushed with a cleaning agent in a closed circuit The insertion of flushing containers or caps presents problems in a conventional closing device whose cap supply means projects at least at one point directly next to or below the closing tools into the rotary plane thereof, since, in the area of the cap supply means, the flushing containers either collide with this means or cannot be used at this point. This applies specifically to crown-cork closing devices in the case of which the crown corks are supplied from a storage container by a cork supply means to a respective closing tool in the correct position It is already known from the prior art (German Utility Model 88 15 956.6, German Patent Application 39 18 504) that the cork supply means is vertically supported in an axially displaceable manner relative to the closing tools, thereby creating an interspace for the insertion of flushing caps. This solution has the disadvantage that, in the area below the closing tools, the closing devices normally comprise built-in means for guiding and centering the vessels to be closed. In the area just below the closing tools, gas channels which rotate together with said tools may additionally be installed for performing a $CO_2$ bottom-cover gas treatment of the corks. These channels make an adequately axial displacement of a cork supply means in the downward direction more or less impossible. Furthermore, an adjustable fastening of the cork supply means calls for additional constructional efforts that are quite considerable.

It is therefore the object of the present invention to provide a vessel closing apparatus which permits a fast and easy cleaning of the closing tools without requiring major conversion work on the periphery of a closing machine.

Since the flushing element is directly inserted into the opening which, in operation, is normally entered by the vessel outlet to be closed, the flushing element can be of a very compact and flat structure, thus requiring only little space. This is especially the case when the flushing element is designed as a flat disc which is substantially in alignment with the bottom side of the closing tool in the inserted state. Such a flushing element is only slightly bigger than the crown cork to be handled.

The flushing elements can be inserted into the opening of a closing tool in an especially easy way when the front side of the pressing means, which is movably guided in the closing tool, is set back relative to the bottom side of the closing tool. Since in practice the pressing means normally includes a magnet for holding the crown corks, a flushing element which contains a magnetic or magnetizable material may be used in the most simple case. The flushing element is then exclusively retained by the magnet in the opening of the closing tool. However, the flushing element itself may also be made from a magnetic material and thus adhere to the closing tool and the pressing means.

A positive connection between the flushing element and the pressing means, e.g. by a screw union, is recommended at high flushing pressures.

With closing tools comprising a pressing means whose front side is not set back with respect to the bottom side of the closing element, but is in alignment therewith or even projects beyond the same, a flushing element may also be inserted into the opening of the closing tool for flushing purposes when the pressing means is axially retractable into the closing tool for flushing operations.

In an especially user-friendly embodiment, a flushing element is movably supported on the closing tool and adapted to be brought from a ready position into a flushing position in which the opening of the closing tool is sealed.

An embodiment shall now be explained in more detail with reference to the accompanying drawings, in which FIG. 1 is an axial section through a closing tool in the operating phase;

Figure 1:
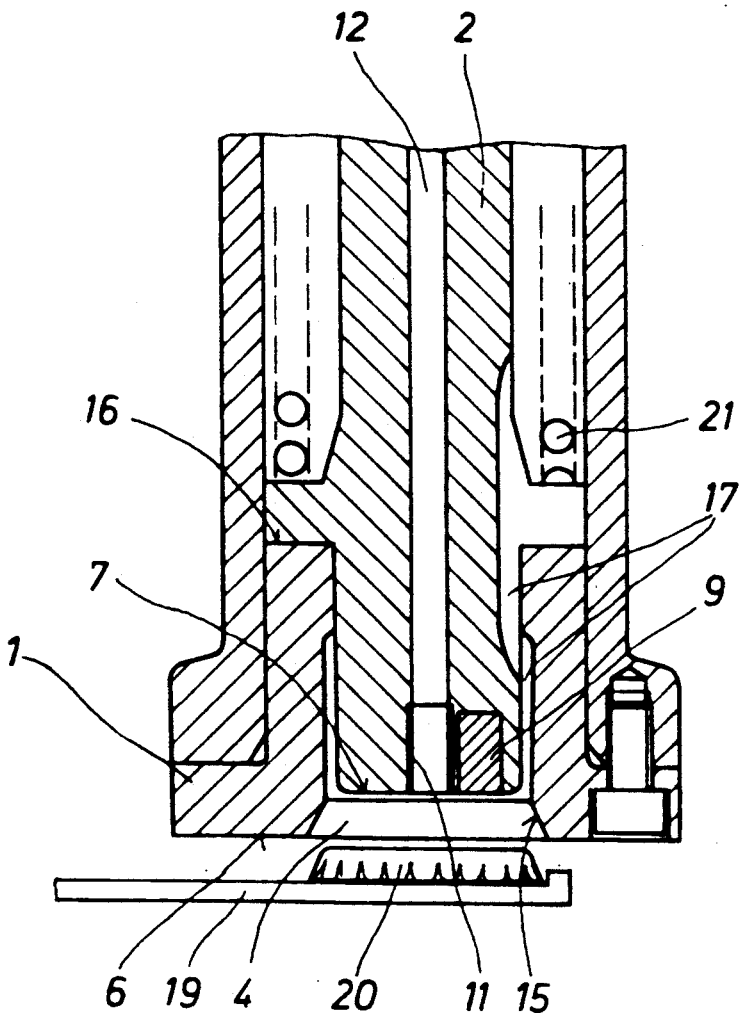

Closing tool 1, which is partly shown in FIG. 1, is axially displaceably mounted on the circumference of a rotatingly drivable revolving means (not shown) in a manner which is known per se. A pressing means 2 which is axially displaceably guided in closing tool 1 and permanently urged by a pressure spring 21 towards its inoperative position defined by a stop 16 is coaxially arranged inside closing tool 1. In this inoperative position, the front side 7 of pressing means 2 is set back relative to the bottom side 6 of closing tool 1. A flushing channel 12 which axially extends up to front side 7 passes through pressing means 2. The front end of flushing channel 12 is formed as a threaded hole 11 for fastening a flushing element 3. Furthermore, a magnet 9 is integrated into the front side 7 of pressing means 2 for retaining crown cork 20 which has been supplied to closing tool 1 prior to the closing operation proper. Flushing chambers 17 which permit a reverse flushing of the whole interior of closing tool 1 together with flushing channel 12 are radially arranged between the lower portion of pressing means 2 and that of closing tool 1. The lower part of closing tool 1 is designed as a separate element for reasons of mounting and wear and detachably secured to the upper part of closing tool 1. The lower, exchangeable part of closing tool 1 includes inner cone 15 which is to bend crown corks 20 after the latter have been put on a vessel outlet. Inner cone 15 simultaneously forms opening 4 through which the mouth of a bottle can enter into closing tool 1 for closing purposes.

FIG. 1 illustrates closing tool 1 in the area of a cork supply means. The cork supply means (not shown in more detail) comprises a supply plate 19 which extends radially from the outside of the rotating path of closing tools 1 to the inside and closely below the bottom side 6 of the closing tools. Crown cork 20 which is positioned on supply plate 19 is attracted by magnet 9 of pressing means 2 when guided past said means and adheres to the front side 7 of pressing means 2 until the closing operation. Thereupon, closing tool 1 is lowered in the known way by a control means (not illustrated) onto the mouth of a bottle which is arranged concentrically below opening 4 of closing tool 1. As soon as the inside of crown cork 20 strikes against the vessel outlet entering through opening 4, the downward movement of pressing means 2 is stopped, while closing tool 1 is further lowered for deforming the crown cork with the aid of inner cone 15. Even before the deformation of the crown cork is started, pressing means 2 exerts a constant pressure through its pressure spring 21 for reliably sealing the mouth of the bottle. This is accomplished by the measure that, after crown cork 20 has hit on the bottle mouth, stop 16 which is integrally formed on pressing means 2 is lifted from its corresponding counter-surface on closing tool 1, whereby the biasing force of pressure spring 21 is transmitted via pressing means 2 onto crown cork 20.

Figure 2:
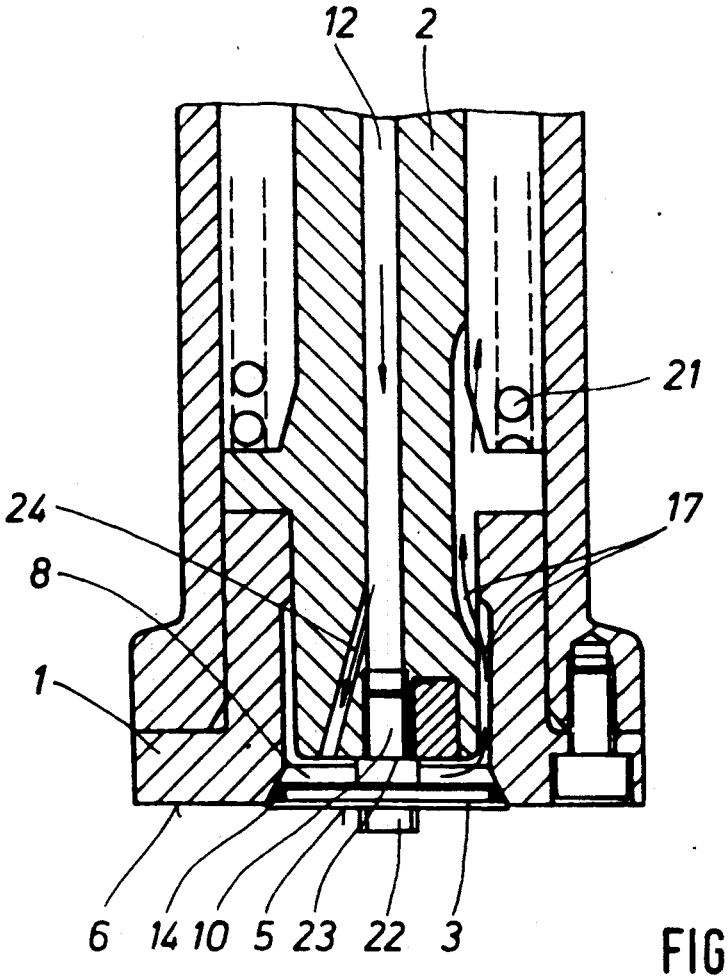
FIG. 2 is an axial section through a closing tool in the flushing phase with an inserted flushing element.

FIG. 2 illustrates the flushing phase of a closing tool 1, with a flushing element 3 being inserted into opening 4 of said tool. Flushing element 3 consists substantially of a flat, circular disc whose circumferential surface is matched to the shape of opening 4 and inner cone 15, respectively. The circumferential surface simultaneously receives an O-ring in a groove. This O-ring forms an elastic sealing surface 14 of flushing element 3. Flushing element 3 can be screwed with its threaded stem 10 into the threaded hole 11 of pressing means 2 until the elastic sealing surface 14 rests on inner cone 15. A hexagonal pin 22 is molded onto the flushing element for screwing purposes. To prevent any damage of the elastic sealing surface 14 on flushing element 3 due to excessive tightening of the screw union, threaded stem 10 has a shoulder 23 which defines the screwing depth by abutting against face 7 of pressing means 2. Shoulder 23 simultaneously guarantees an interspace 8 between the front side 7 of pressing means 2 and flushing element 3, so that a major part of front side 7 is wetted by the flushing medium during the flushing operation. An inclined bore 24 which branches from flushing channel 12 permits a complete reverse-flushing operation. Cleaning liquid which has been introduced into flushing channel 12 can be passed through the inclined bore 24 into interspace 8 which is provided between flushing element 3 and front side 7 of pressing means 2, and can rise from there through flushing chambers 17 on the cricumferential surface of pressing means 2 upwards into the spring chamber of closing tool 1.

Figure 3:
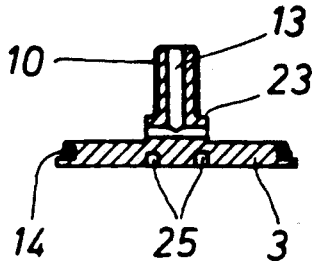
FIG. 3 is an axial section through a flushing element which differs from the embodiment of a flushing element as illustrated in FIG. 2.

The inclined bore 24 can be-dispensed with in cases where a flushing element, as shown in FIG. 3, is used whose threaded stem 10 includes a cavity 13 which connects flushing channel 12 to interspace 8. Cavity 13 may, e.g., be formed by a blind hole arranged axially inside said threaded stem 10 and by a through hole vertically extending relative thereto inside shoulder 23. Flushing element 3 which is shown in FIG. 3 differs from that illustrated in FIG. 2 by the feature that two front blind holes 25 extending in parallel with each other are provided for tightening and releasing flushing element 3, instead of an outwardly projecting hexagonal pin 22. As a result of this construction, the bottom side 5 of flushing element 3 is entirely flush with the bottom side 6 of closing tool 1.

To be in a position to remove possibly adhering impurities inside the threaded hole 11 and the region of inner cone 15, which is in contact with the sealing surface 14 of flushing element 3, both flushing channel 12 and flushing chambers 17 may be flushed from the top to the bottom after flushing element 3 has been removed, thereby passing impurities through opening 4 to the outside. This makes sure that all critical surfaces within closing tool 1 are fully treated.

Figure 4:
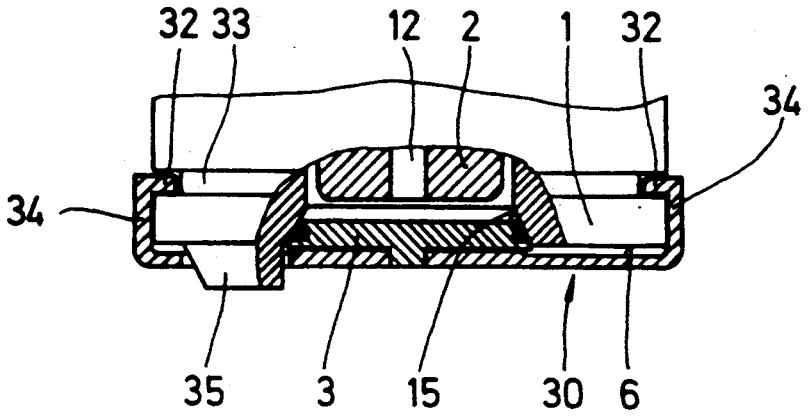
FIG. 4 is an axial section through a closing tool in the flushing phase, with a flushing element being secured to the closing tool.

In the embodiment illustrated in FIG. 4, flushing element 3 is similar to the flushing element shown in FIG. 2. However, flushing element 3 is here not retained by pressing means 2, but is pressed into the inner cone 15 of closing tool 1 by a support element 30 which is adapted to be secured to closing tool 1. To this end, flushing element 3 is rotatably riveted to support element 30. The pot-shaped support element 30 has a substantially U-shaped cross-section, the vertical walls 34 of support element 30 surrounding closing tool 1 on its lateral circumferential surface, at least in part. A plurality of holding tongues 32 which are oriented radially inwards towards closing tool 1 and engage an annular groove 33 which is integrally molded on closing tool 1 are mounted on the upper edge of the vertical walls 34. Support element 30 is secured in the manner of a bayonet fixing by first sliding support element 30 from below axially onto closing tool 1 and subsequently securing the same through turning. To permit such an axial sliding operation for support element 30 with the integrally molded holding tongues 32, the lateral circumferential surface of closing tool 1 includes flat portions (not shown) in the area between annular groove 33 and bottom side 6 of closing tool 1, the width of these flat portions corresponding at least to that of holding tongues 32.

Furthermore, FIG. 4 shows an engaging pin 35 which is integrally molded on the bottom side 6 of closing tool 1 and is to carry along a crown cork 20, which is kept ready, in the rotating direction of closing tool 1 when being guided past the cork supply means outlined in FIG. 1. To obtain a support element 30 which is as flat as possible despite this engaging pin 35, i.e. which hardly projects from the bottom side 6 of closing tool 1, support element 30 has a window-like opening 31 through which engaging pin 35 can pass. The window-like opening 31 is designed such that the rotational movement which is required for securing support element 30 can be carried out without hindrance.

Figure 5:
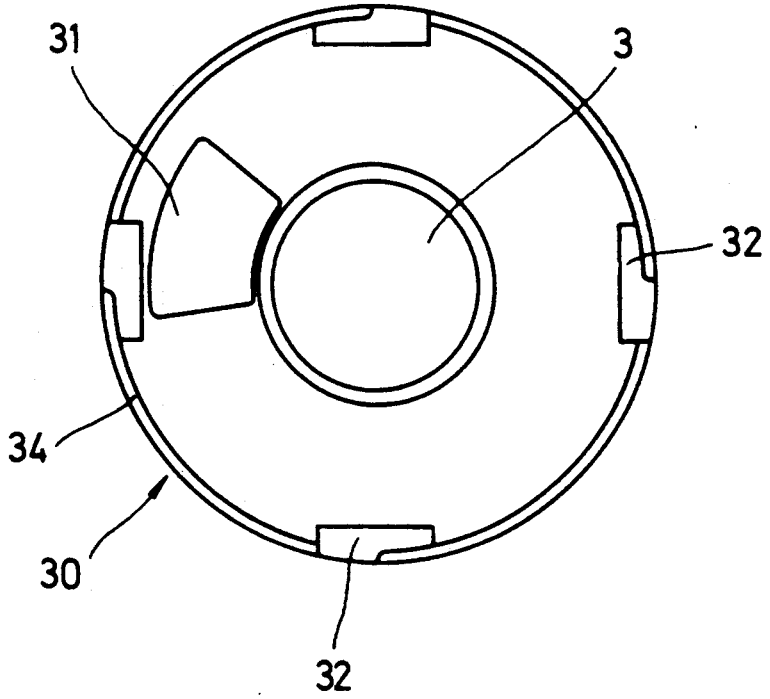
FIG. 5 is a top view on the flushing element without the closing tool of FIG. 4.

The fastening of flushing element 3 to closing tool 1, as is shown in FIGS. 4 and 5, is expedient in cases where a fastening to pressing means 2 is not possible for technical reasons, or whenever an overall cleaning of the front side 7 of pressing means 2 is desired. Since closing tool 1 is sealed in opening 4, a very flat design, i.e. one requiring only little space, is made possible despite the mounting on closing tool 1.

I claim:

1. In an apparatus for capping vessels comprising at least one closing device incorporating a pressing means positioned axially displaceably in a closing tool for securing a closing cap on the mouth of a vessel by said pressing means at a point in said closing tool where said closing cap is placed on and fixedly secured to the mouth of said vessel which is arranged within an opening in the lower portion of said closing tool, the improvement of means for washing portions of said closing tool, said washing means comprising:

a flushing channel extending axially through said pressing means, one end of said flushing channel being in communication with a washing solution source and the other end of said flushing channel opening into a bottom surface of said pressing means, a flushing element cap fastenable within said opening in sealable contact with said opening and forming a channel between the bottom surface of said pressing means and a top surface of said element cap, said channel formed between said pressing means and said flushing element cap being in communication with said flushing channel.

2. The apparatus of claim 1, wherein said flushing element cap is provided with elastic sealing means adapted for sealable contact between an outer edge of said element cap and said opening.

3. The apparatus of claim 1, wherein the shape of said opening in the lower portion of said closing tool is circumferential and wherein the shape of said flushing element cap is circumferential whose outer perimeter surfaces are matched to the inner peripheral surfaces of said opening.

4. The apparatus of claim 1, wherein a flushing chamber area is provided between an inner surface of said closing tool and an outer surface of said pressing means, said flushing chamber area being in communication with said channel formed between the bottom of said pressing means and the top of said flushing element cap.

5. The apparatus of claim 1, wherein said flushing element cap is fastened to said pressing means when the element cap is in sealable contact with said opening of said closing tool.

6. The apparatus of claim 5, wherein said flushing element cap is fastened to said pressing means by means of a threaded stem on said cap engaged with a threaded hole in a lower portion of said pressing means.

7. The apparatus of claim 6, wherein said flushing element cap is coaxially threaded into said flushing channel.

8. The apparatus of claim 7, wherein said flushing channel is in communication through said threaded stem of said cap with the channel formed between the bottom surface of said pressing means and the top surface of said flushing element cap.

9. The apparatus of claim 1, wherein a bottom side of said flushing element cap is substantially in alignment with a bottom side of said closing tool.

10. The apparatus of claim 1, wherein said flushing element cap is fastened to the lower portion of said closing tool.

11. The apparatus of claim 10, wherein said flushing element cap is mounted on a support element having a substantially U-shaped cross-section that, at least in part, laterally surrounds the lower portion of said closing tool when the cap is fastened within said opening.

12. The apparatus of claim 1, wherein said flushing element cap is movably supported on said closing tool and is adapted to be brought from a ready position into a sealable position with said opening.

* * * * *